US006123470A

United States Patent [19]

Chiu

[11] Patent Number: 6,123,470

[45] Date of Patent: Sep. 26, 2000

[54] WIRELESS SELF-PROPELLING PRINT-HEAD

[75] Inventor: Shun Pui Chiu, Kowloon, The Hong Kong Special Administrative Region of the People's Republic of China

[73] Assignee: N K Technology LTD, The Hong Kong Special Administrative Region of the People's Republic of China

[21] Appl. No.: 08/900,166

[22] Filed: Jul. 25, 1997

[51] Int. Cl.[7] ..... B41J 1/56

[52] U.S. Cl. ..... 400/175; 400/319; 400/320

[58] Field of Search ..... 400/279, 320, 400/319, 322, 323, 174, 175

[56] References Cited

U.S. PATENT DOCUMENTS 4,396,305 8/1983 Shattuck et al. ..... 400/320
4,403,879 9/1983 Vought et al. ..... 400/320
5,087,134 2/1992 Tanuma et al. ..... 400/54
5,310,272 5/1994 Nishizawa ..... 400/279
5,368,402 11/1994 Takahashit et al. ..... 400/279
5,567,063 10/1996 Chiu .

*Primary Examiner*—John S. Hilten
*Attorney, Agent, or Firm*—Burns, Doane, Swecker & Mathis, L.L.P.

[57] ABSTRACT

A printer head includes a wireless print head provided with a memory buffer for storing data corresponding to at least one line of data. The print head is also provided with a motor and runs along a guide means in a self-propelled manner, the print head further includes power pick-up means for taking power for the motor from the guide means. In one embodiment for example the guide means are a pair of parallel metal rails connected to a power supply and the print head includes metal wheels and brush means. In this way the amount of cabling required to connect to the print head to a controlling computer may be minimized.

11 Claims, 8 Drawing Sheets

WIRELESS SELF-PROPELLING PRINT-HEAD

FIELD OF THE INVENTION

This invention relates to a printing head, and in particular though not exclusively to a printing head for an ink-jet or bubble-jet printer.

BACKGROUND OF THE INVENTION

Ink-jet and bubble-jet printers have become in recent years increasingly popular in the high-volume and low-cost end of the printer market. They produce good quality prints at a relatively low cost compared to, for example, laser printers and as such they are well suited for small business and domestic users. However, there is scope for reducing further the cost and size of such printers.

A conventional ink-jet printer comprises a printer cartridge which is mounted on a carriage for movement to and fro across the width of the paper. The cartridge comprises a supply of ink and means for directing the ink from a plurality of fine nozzle outlets toward the paper. A number of other elements will also be provided either as part of the printer cartridge or the carriage. These include, for example, thermal elements for producing the ink-jets, paper sensing means, and position encoding means for determining the position of the carriage relative to the main body of the printer and the paper.

However, the main printer head control means, which tells the printer cartridge what to print and where depending on an input from an external source such as a personal computer, is located remote from the printer cartridge and is connected to the cartridge by a flexible cable. Depending on the number of print nozzle outlets provided in the cartridge, the flexible cable will require a large number of individual wires, as much as 50 or 60 or even more. Such cables are well known and the individual wires are generally disposed to form a flat wide cable.

These cables are, however, expensive and in the low-end of the printer market they represent a significant amount of the total cost of a printer. Furthermore because they connect to a moving printer head they must be quite long to allow for this movement and a substantial empty space must be left in the printer so as to allow the cable to move without obstruction as the printer head moves to and fro. This increases the size of the printer beyond what would otherwise be necessary and thus further increases the cost of the printer.

Such flexible cables present further difficulties. The individual wires tend to be very fine and can thus easily break, especially when subject to repeated bending as the printing head moves back and forth, and they are also subject to noise interference unless the cable is shielded, and shielding the cable further adds to the cost of a printer.

U.S. Pat. No. 5,567,063 discloses a partial solution to these problems. In U.S. Pat. No. 5,567,063 a cordless printing head control system is described in which the need for a data-transmitting cable is eliminated. In this patent the printer head is provided with a memory buffer of sufficient storage capacity to store at least one line of data for printing, and this memory buffer is provided with fresh data every time the printer head comes to one end of its travel.

Although an advance on the prior art, the arrangement of U.S. Pat. No. 5,567,063 does not solve all the problems. In particular means have to be provided for moving the printer head across the paper and in U.S. Pat. No. 5,567,063 this is done in a conventional manner with the printer head being driven through a timing belt driven in turn from a drive motor. The provision of a timing belt and of the drive motor both occupy space in the printer militating against further reduction in size, and also add to cost. Furthermore a separate power cable must go to the printer head to provide a source of power.

SUMMARY OF THE INVENTION

According to the present invention there is provided a printer comprising, means for feeding paper through said printer in a feed direction, printer head guide means for guiding movement of a printer head in a direction normal to said paper feed direction, said printer head including power pick-up means engaging said guide means, motor means and drive means, and power supply means for supplying power to said guide means.

By means of this arrangement a wireless self-propelling printer head may be provided that eliminates the need for a timing belt for driving the printer, and which eliminates the need for a power cable connected to the printer head. This is achieved by providing the printer head with its own drive means and, as a source of power, taking advantage of the connection between the printer head and the guide means.

The invention is particularly suitable for use in conjunction with a cordless printer head of the type described in U.S. Pat. No. 5,567,063 which is hereby incorporated by reference since in such a situation a printer head may be provided with no cable connections to the printer whatsoever—but instead only the physical connection of the self-contained printer head on the guide means.

Preferably the guide means may comprise a pair of spaced part parallel metal rails, and the printer head may be provided with wheels so as to run along the rails in the manner of a train or a carriage. If the wheels are made of metal or any other conductive material and if the guide rails are connected to the power supply, the physical connection between the wheels and the rails may also serve as the electrical connection. The wheels may then be provided with axles from which the power is taken by brush means provided on the printer head. The printer head may be provided with a simple electrical motor which in turn then drives the wheels through a gear train so as to propel the printer head along the guide rails.

Viewed from another aspect the present invention provides a printer comprising a wireless print head adapted to move along guide means across a sheet of paper, said print head including a motor means whereby in use said printer is self-propelled along said guide means.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
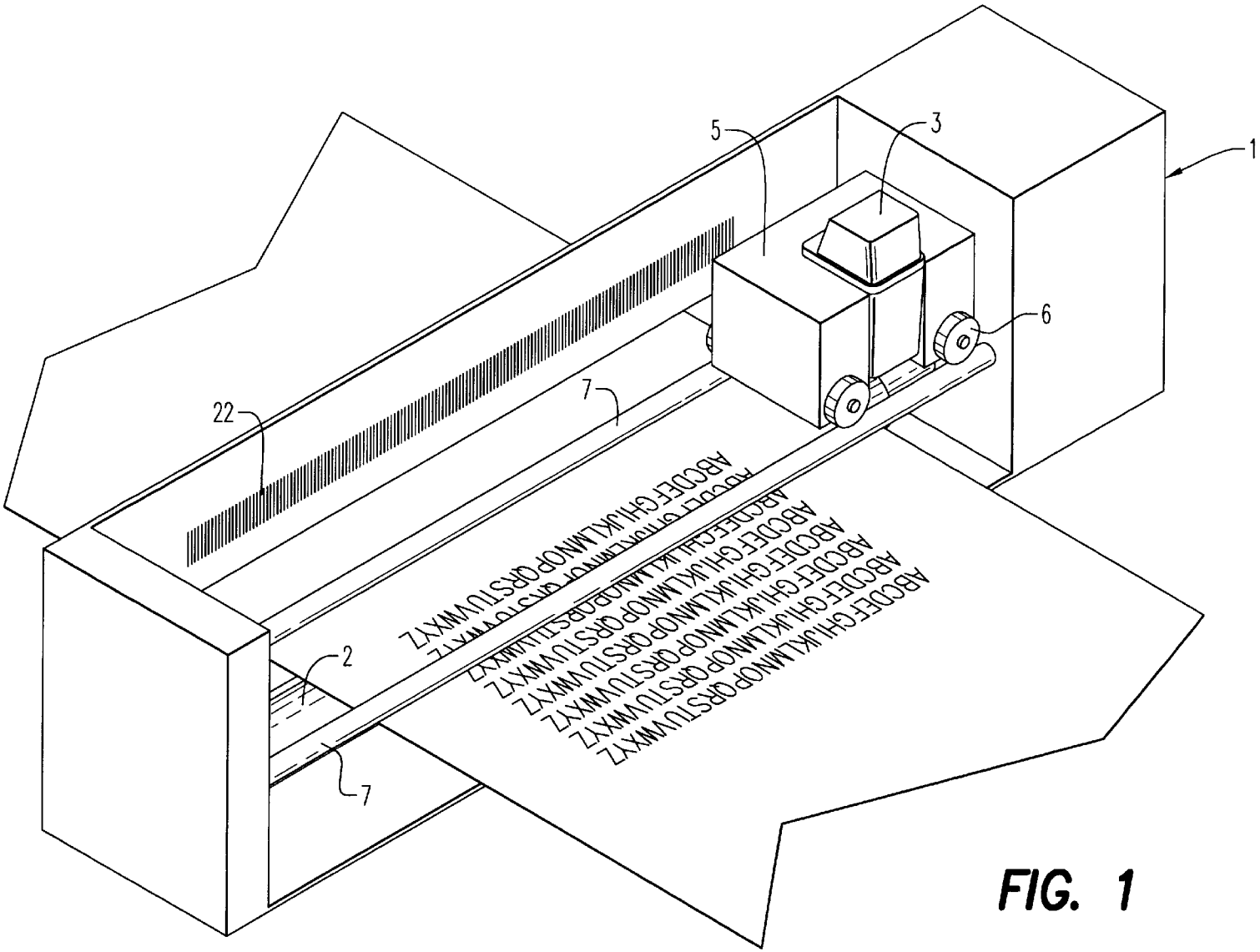
FIG. 1 is a perspective view of a printer according to an embodiment of the invention with the printer head at the beginning of a line.
Figure 2:
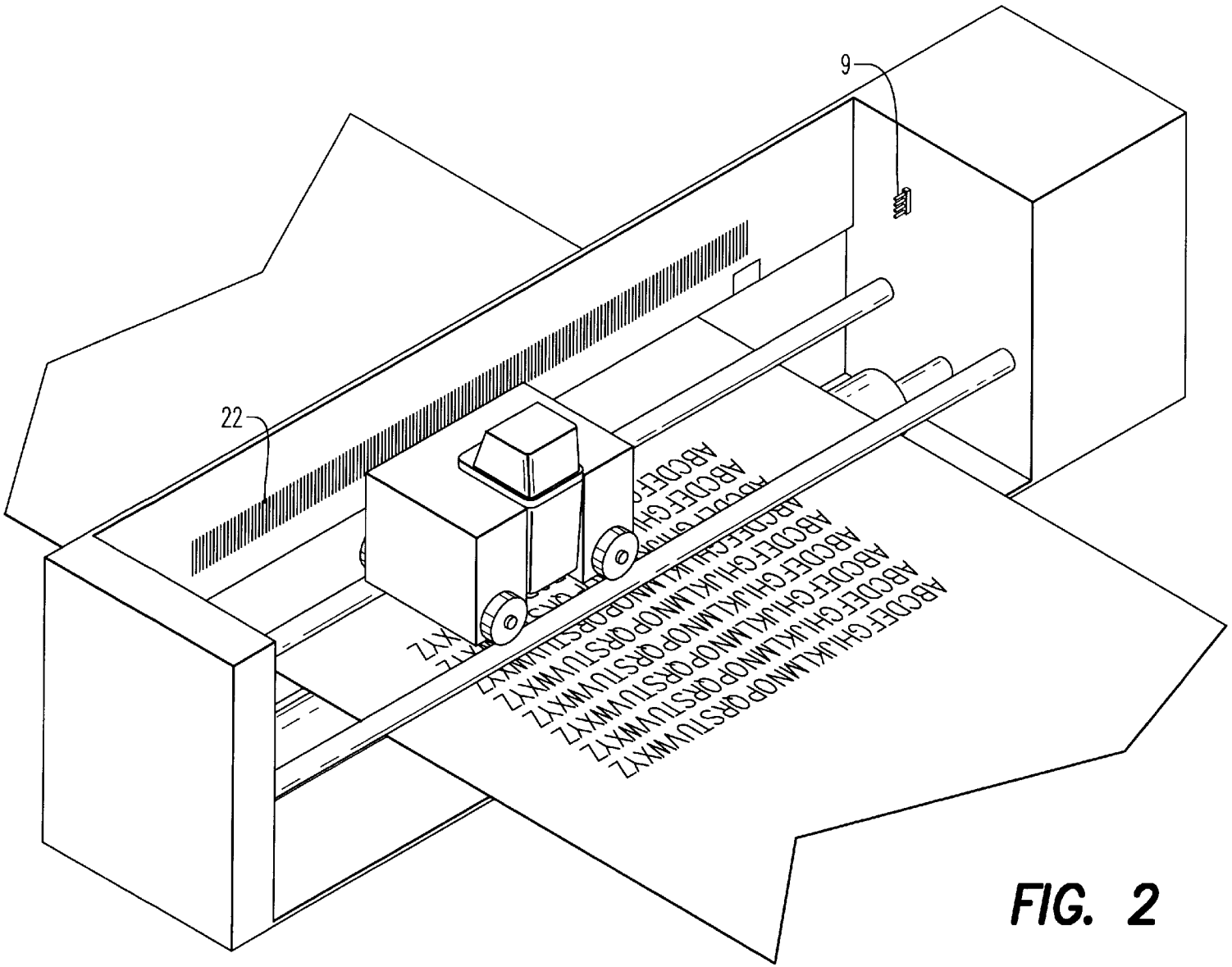
FIG. 2 is a view corresponding to FIG. 1 but with the printer head in transit.
Figure 3:
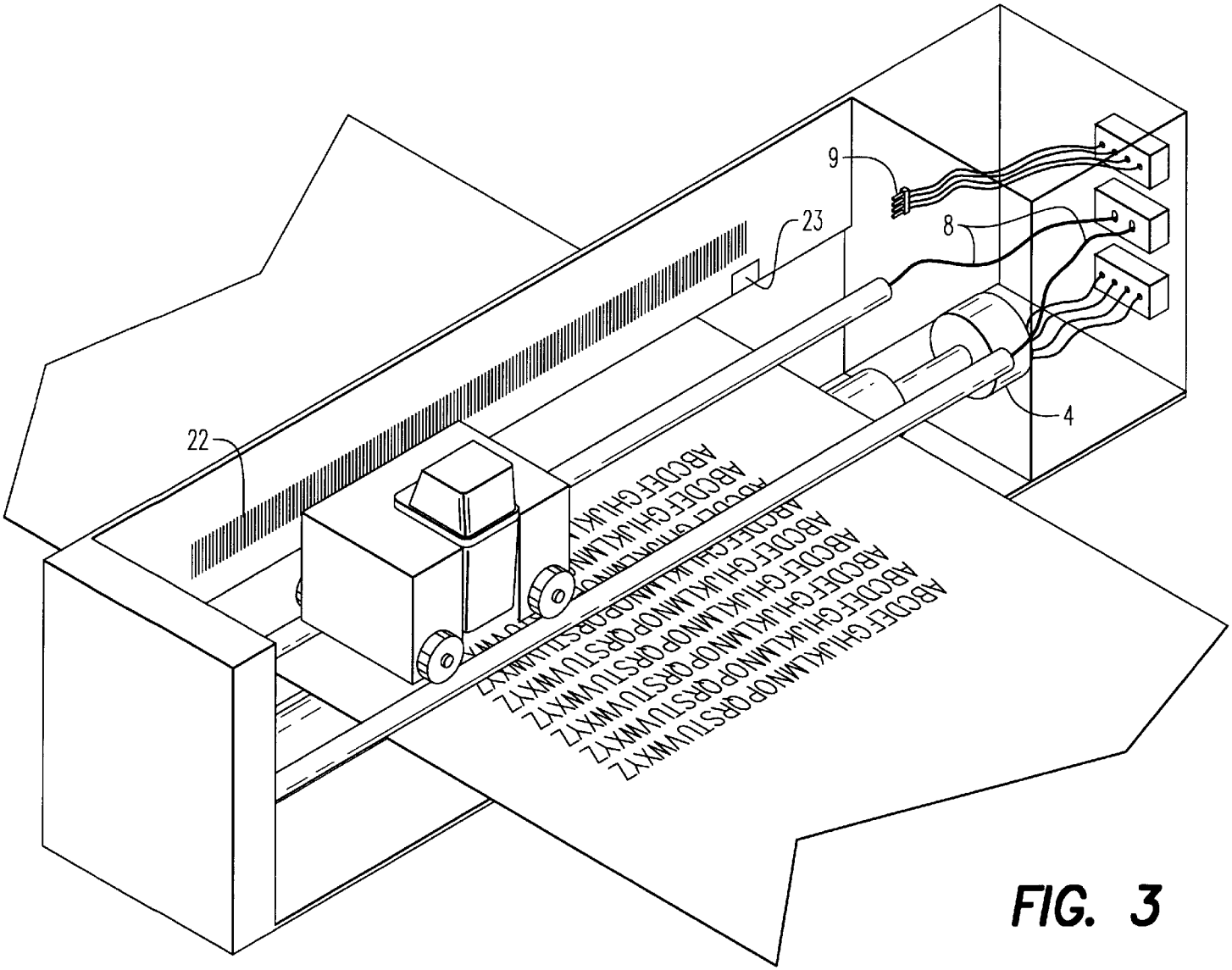
FIG. 3 is a view similar to FIGS. 1 & 2 but with one end exploded for clarity.

Referring firstly to FIGS. 1 to 3 there is shown a printer comprising a printer body 1, a paper feed roll 2 and a printer head 3. Normally the printer head 3 and the feed roll 2 would be enclosed within a housing but this has been removed in the figures for the sake of clarity. The paper feed roll 2 is conventional in nature and is driven from a power supply by drive means 4 (FIG. 3). Paper feed roll 2 feeds paper through the printer in a direction at right angles to the lines of print in a conventional manner.

The printer head 3 is located on a carriage 5 comprising four wheels 6. The four wheels are arranged as a front pair and a rear pair and rest on two parallel spaced apart guide rails 7 which extend substantially across the width of the printer body in a direction normal to the paper feed direction, ie in a direction parallel to the lines of print to be printed on the paper. The guide rails 7 are made of metal and are connected to the opposite poles of a power supply by power supply leads 8 (FIG. 3). The wheels 6 are also made of metal and function as a power pick-up from the guide rails in a manner to be described further below.

Not shown in FIGS. 1 to 3 but to be described below, the carriage includes an electric motor which is driven from the power taken from the electrified drive rails and a drive gear train which in turn drives the wheels 6 so as to propel the carriage back and forth along the guide rails 7 across the paper. Although in principle the printer head 3 could be provided with a cable connection to the printer control means, preferably it is formed with an internal memory buffer large enough to store the data for at least one line of print and new data is downloaded into the buffer either at the end of each transit of the paper, or after two transits, ie one across and one back, when the carriage returns to its "home" position. Data transfer means 9 are shown in FIGS. 2 & 3 and may take any of the forms described in U.S. Pat. No. 5,567,063.

Figure 4:
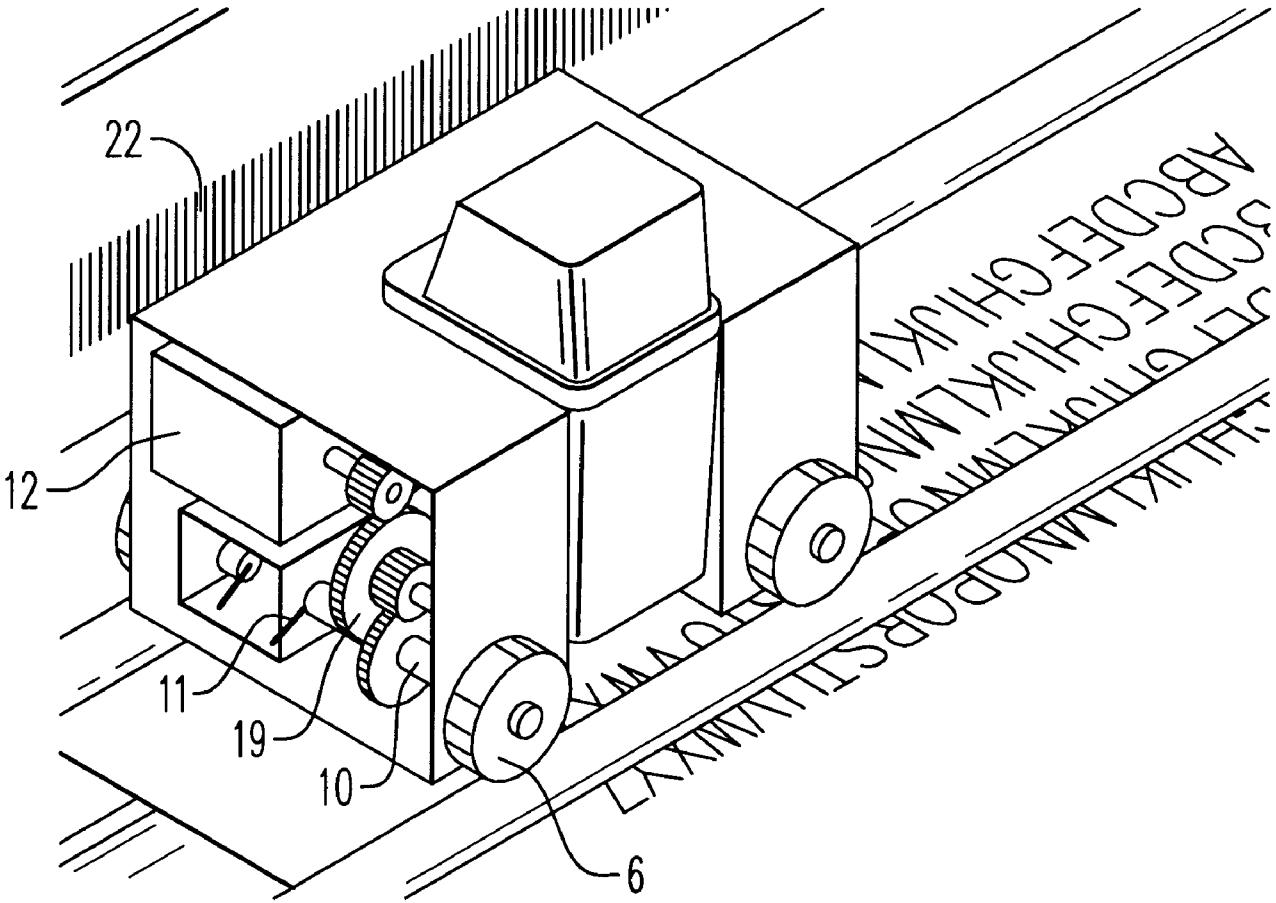
FIG. 4 shows a printer head in greater detail.
Figure 5:
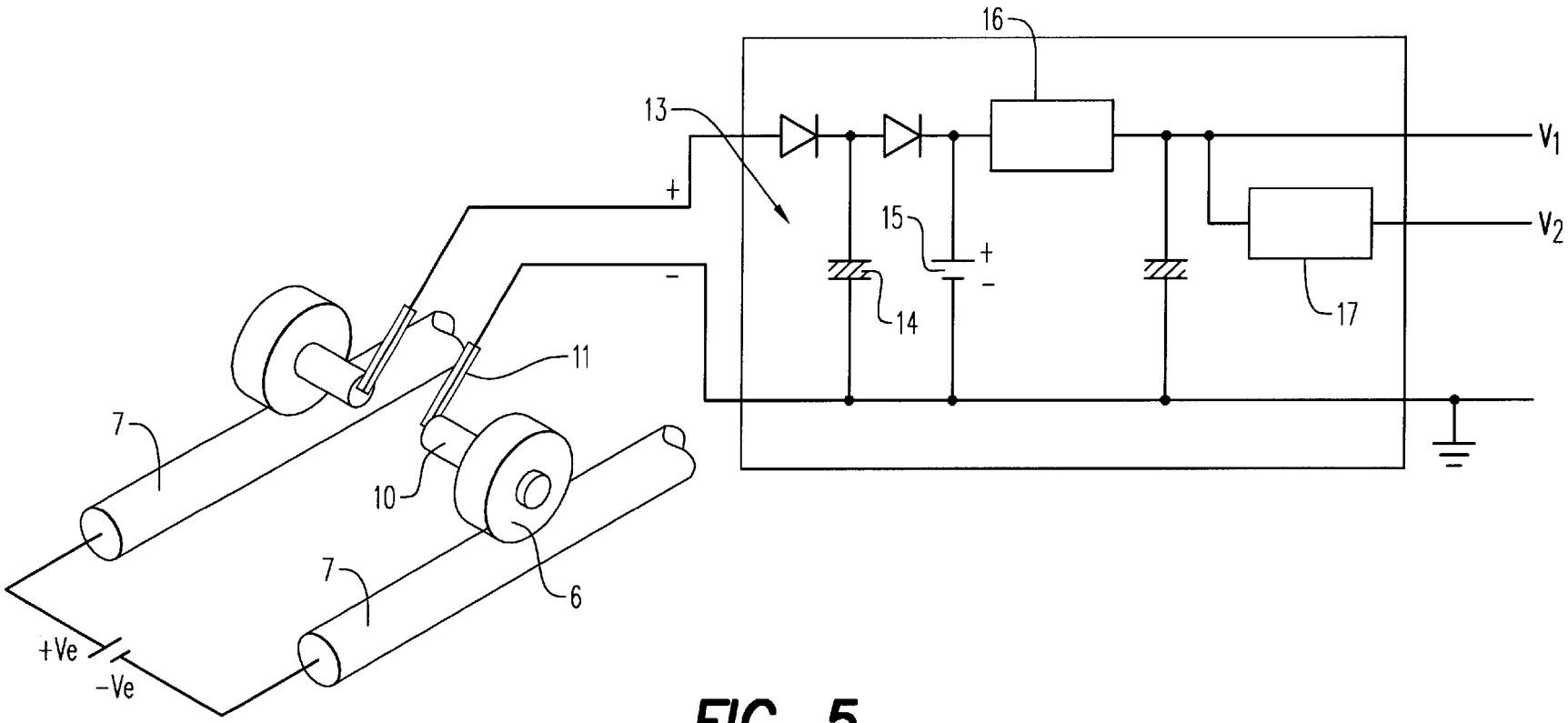
FIG. 5 shows a power supply circuit.
Figure 6:
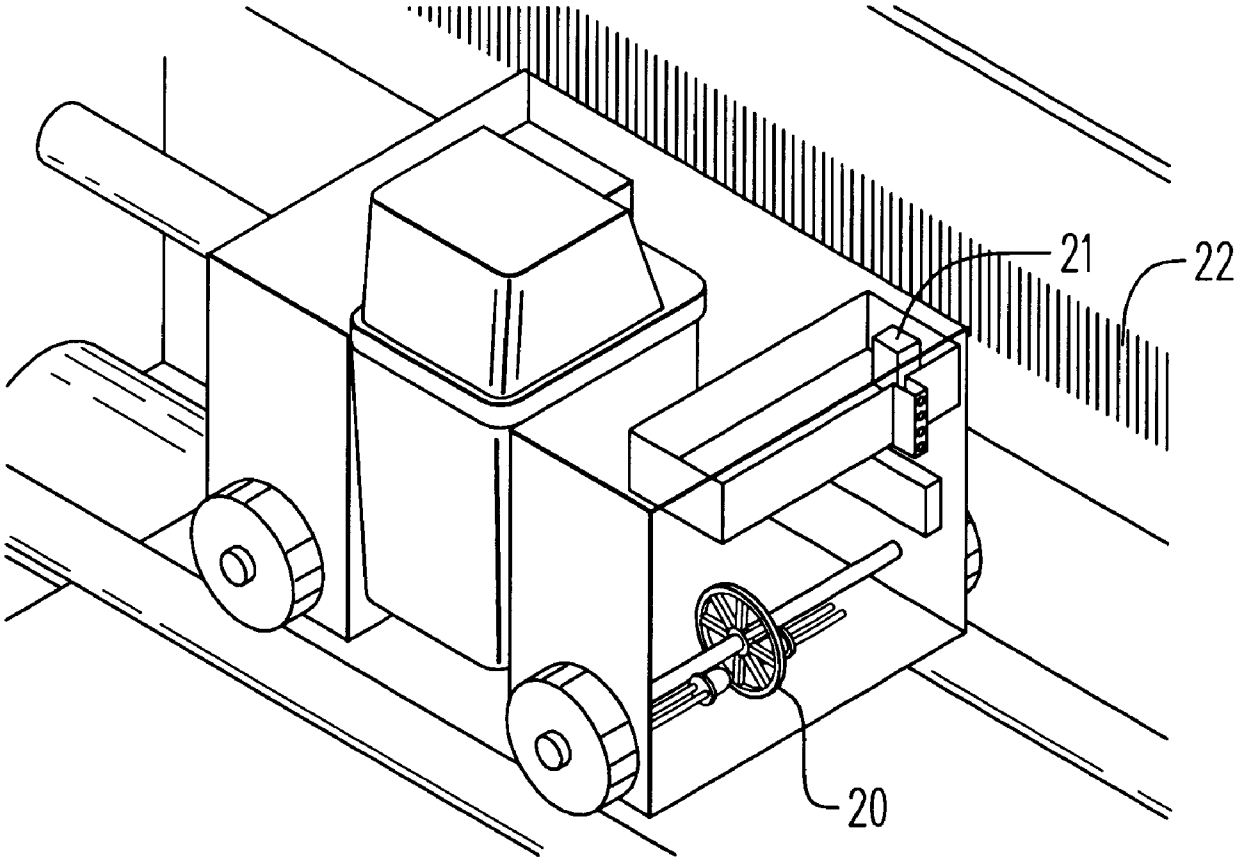
FIG. 6 shows a printer head synchronisation means, FIG. 7 graphically illustrates a printing line cycle.

FIGS. 4 and 5 show the manner in which the carriage is driven in more detail. Referring to FIG. 5 either the front or the rear wheel pair are provided with metal axles 10 which in turn are contacted by pick-up brushes 11. Since the guide rails have a relative potential between them, the pick-up brushes 11 deliver this potential as a power supply to the motor 12 provided in the carriage. The brush connections mean, however, that the power supply is susceptible to noise and occasional interruption which in theory could reduce print quality. To improve the quality of the power supply, therefore, a smoothing circuit is provided. The smoothing circuit comprises a first filter stage 13 to reduce the noise from poor mechanical connections and which includes a capacitor 14 which can also serve as a temporary power storage in the event of an interruption. In case of a longer power interruption the next stage in the power smoothing circuit includes a rechargeable battery 15. The remaining stages comprise a regulator stage 16, and voltage converter stage 17 which produces the desired final output.

The motor 12 is located within the carriage and drives either the front or rear wheel pair through a gear train 19 (FIG. 4). In the embodiment shown it is the front wheel pair that is used to both to drive the carriage and also as a power pick-up. This leaves the other, rear, wheel pair free for use as a sensing means to determine the speed of movement of the carriage. This sensing means comprises a rotating disc 20 fixed to the rear axle and an optical or other sensor which is adapted to detect rotation of the disc 20 and thus the speed of the carriage or simply the number of rotations of the axle and hence the distance travelled by the carriage.

Referring to FIGS. 1 to 3 and 6 it will be seen that along the side of the printer housing adjacent and parallel to the guide rails 7 is formed a position indication means 22. This may take any convenient form, for example an optical bar-code or an electromagnetic code, and in conjunction with a position sensor 21 formed on the printer head provides a position signal. The nature of the position sensor 21, ie an optical sensor, a magnetic sensor or the like, will of course depend on the nature of the position indication means 22. In addition to the position indication means 22, a home position indication means 23 is provided to indicate when the carriage is in a home position. In conjunction with the speed sensing means, the position sensor and the home position sensor provides data about the position and speed of the carriage which may be used to synchronise the movement of the printer head with the print operation in the manner to be described below.

Figure 8:
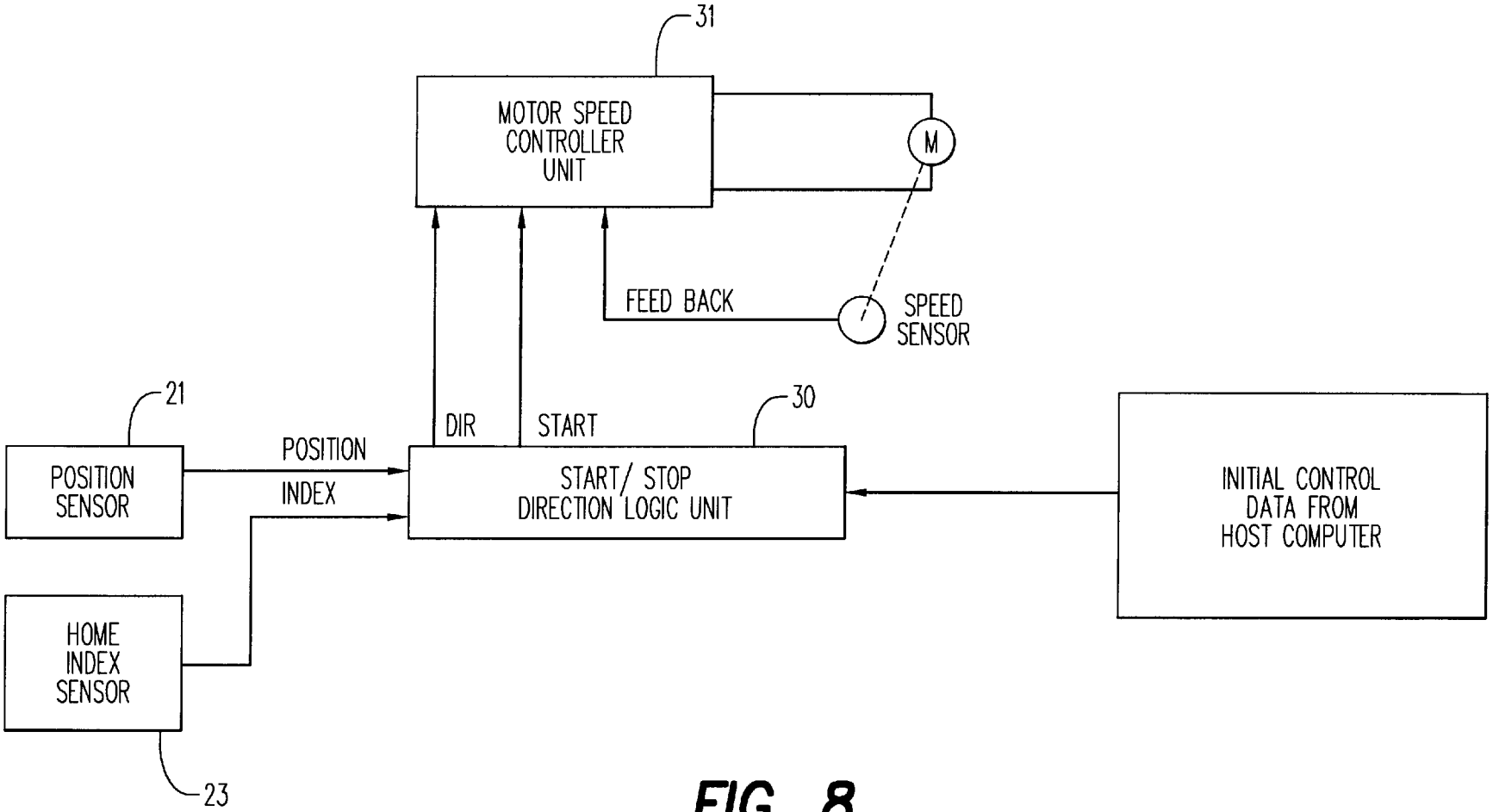
FIG. 8 is a block diagram showing the motor control.

Turning now to FIG. 8 there is shown a block diagram of a control system for controlling movement of the printer head. The control system includes a start/stop direction logic unit 30 which via a motor speed controller unit 31 controls the supply of current to the guide rails (and also its polarity) which therefore controls the movement (and direction) of the printer head. The logic unit 30 receives inputs from the position sensor 21 and the home index sensor 23. It also receives as an input initial control data from the computer controlling the printer. This data may include, for example, the start position, paper and therefore printing width and so on. As an output the logic unit 30 in turn controls the motor through a motor speed control unit that controls both the motor speed and the direction of rotation. The motor control unit also in turn receives an input in the form of a feedback signal from the speed sensor 20.

Figure 7:
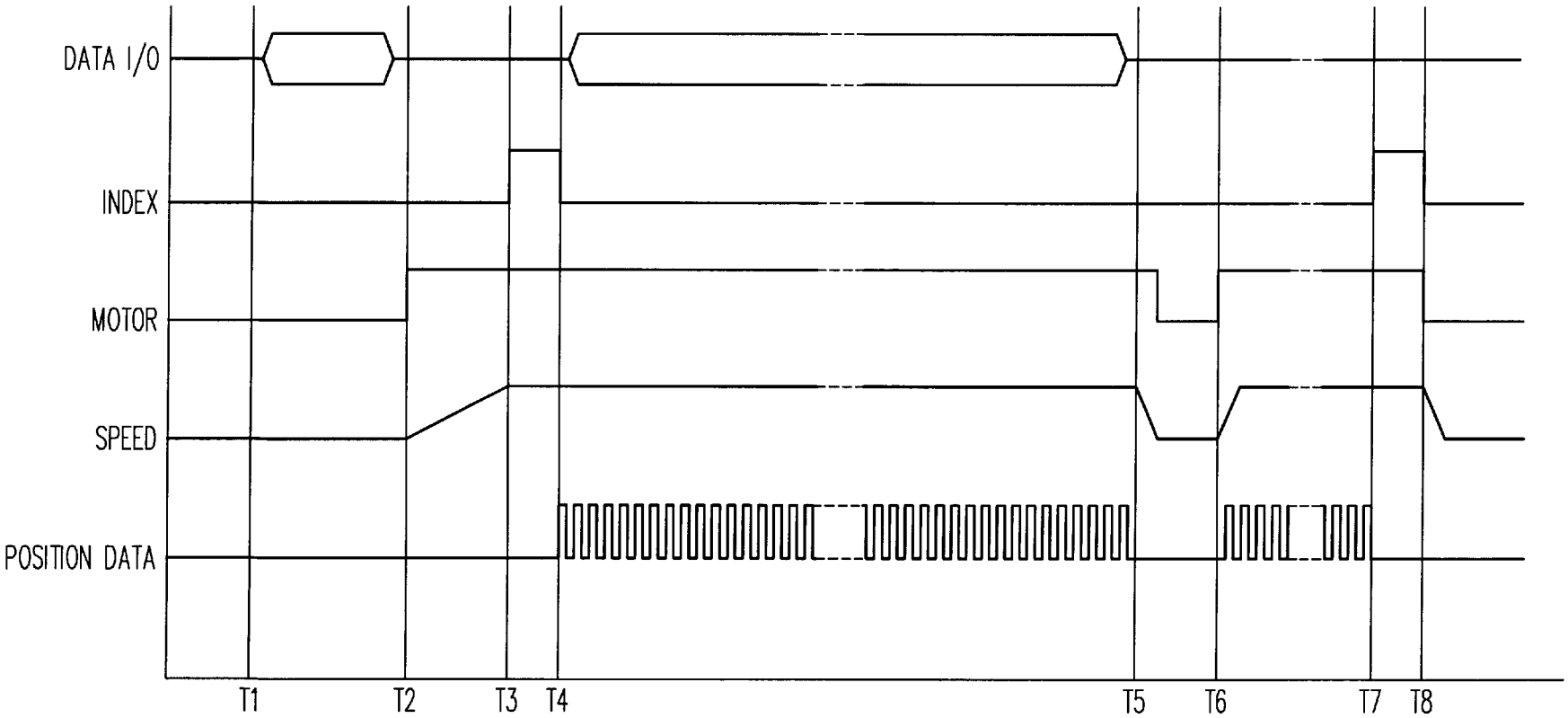

FIG. 7 schematically illustrates operation of the invention. To begin with between times T1 and T2 data is downloaded to the buffer on the printer head as in U.S. Pat. No. 5,567,063. At T2 the motor is started and the motor speed ramps up to the desired constant speed by time T3. When the printer head then identifies a designated index position from the position sensor printing of data from the buffer commences. During the printing the timing is synchronized with the position sensor feedback by phase-locking an internal clock to the position sensor output pulse.

The motor is stopped just after T5 when the printer head reaches the pre-defined end of the printing distance or the end-of-line position is detected. The motor then changes direction to allow the printer head to return to its start position and data can be printed in this return leg in the same manner. Alternatively if the buffer is smaller, printing may only be performed in one direction.

It will be appreciated that the invention provides a number of advantages over a conventional arrangement. It reduces still further the need for cabling and also the need for a timing belt. These advantages are particularly relevant if the invention is embodied in a printer designed for very wide paper printing. Furthermore the modular design of the printer head allows for easy production assembly and maintenance, and of course one printer head can very easily be interchanged for another, or indeed multiple printer heads may be used at the same time.

What is claimed is:

1. A printer comprising, means for feeding paper through said printer in a feed direction, printer head guide means comprising a pair of spaced apart parallel conducting rails for guiding movement of a printer head in a direction normal to said paper feed direction, said printer head including power pickup means including metal wheels adapted to engage said rails, motor means and drive means, and power supply means for supplying power to said guide means.

2. A printer as claimed in claim 1 wherein said printer head further includes motor control means for controlling the speed and direction of said motor, means for supplying said motor control means with initial control data, and said motor control means receiving inputs from position and speed sensors concerning the instant speed and position of said printing head.

3. A printer as claimed in claim 1, wherein said printer head is wireless.

4. A printer as claimed in claim 1 wherein at least two of said wheels are provided with associated brush means to supply power to said motor.

5. A printer as claimed in claim 1 wherein said printer head includes a position sensor.

6. A printer as claimed in claim 5 wherein said position sensor detects the position of said printer head by reference to position indication means provided on a body portion of said printer.

7. A printer as claimed in claim 1 wherein said printer head is provided with a speed sensor.

8. A printer as claimed in claim 7 wherein said printer is provided with at least one pair of wheels connected by an axle and said speed sensor senses rotation of said axle.

9. A printer as claimed in claim 1 further comprising means for synchronizing the printing of data with the speed of movement and position of said printer head.

10. A printer comprising, means for feeding paper through said printer in a feed direction, printer head guide means for guiding movement of a printer head in a direction normal to said paper feed direction, said printer head including power pickup means engaging said guide means, motor means, drive means, and a speed sensor, and power supply means for supplying power to said guide means.

11. A printer as claimed in claim 10 wherein said printer is provided with at least one pair of wheels connected by an axle and said speed sensor senses rotation of said axle.

* * * * *